US005102615A

United States Patent [19]

Grande et al.

[11] Patent Number: 5,102,615

[45] Date of Patent: Apr. 7, 1992

[54] METAL-CLAD CONTAINER FOR RADIOACTIVE MATERIAL STORAGE

[76] Inventors: Lou Grande, 27 Caledonia Road, Toronto, Ontario, Canada, M6E 4S3; Phillip J. Armstrong, 271 McRaney St. W., Oakville, Ontario, Canada, L6H 3A9

[21] Appl. No.: 482,916

[22] Filed: Feb. 22, 1990

[51] Int. Cl.[5] ..... G21C 19/00

[52] U.S. Cl. ..... 376/272; 250/506.1

[58] Field of Search ..... 376/272; 250/506.1, 250/518.1; 252/478

[56] References Cited

U.S. PATENT DOCUMENTS

| | | | |
|---|---|---|---|
| 2,514,609 | 7/1950 | Strickland | 376/272 |
| 3,229,096 | 1/1965 | Bonilla | 376/272 |
| 3,448,460 | 6/1969 | Hall | 376/272 |
| 3,828,197 | 8/1974 | Boldt | 250/506 |
| 4,257,912 | 3/1981 | Fleischer et al. | 376/272 |
| 4,336,460 | 6/1982 | Best | 376/272 |
| 4,399,366 | 8/1983 | Bucholz | 376/272 |
| 4,445,042 | 4/1984 | Baatz et al. | 376/272 |
| 4,521,372 | 6/1985 | Price | 376/272 |
| 4,527,065 | 7/1985 | Popp | 376/272 |
| 4,666,659 | 5/2987 | Lusk | 376/272 |
| 4,702,391 | 10/1987 | Koester et al. | 376/272 |
| 4,752,437 | 6/1988 | Ito et al. | 376/272 |
| 4,800,062 | 1/1989 | Craig | 376/272 |
| 4,935,943 | 6/1990 | Schweitzer | 376/272 |

*Primary Examiner*—Donald P. Walsh

*Attorney, Agent, or Firm*—Ridout & Maybee

[57] ABSTRACT

A container for storing and transporting radioactive material is provided comprising: a vessel, having an upwardly open cavity for accommodating radioactive material; and a cap covering the top surface of the vessel to seal the cavity. The vessel and cap walls have a core of radioactive shielding material such as cementatious, concrete enveloped and isolated within a continuous metal lining. The metal lining allows the container to be held under water, improves the impact resistance of the container and forms a barrier in a geological disposal facility. The lower edge of the cap and upper edge of the vessel are welded together to seal the cavity. The vessel includes lifting lugs for lifting the vessel and container.

14 Claims, 4 Drawing Sheets

METAL-CLAD CONTAINER FOR RADIOACTIVE MATERIAL STORAGE

BRIEF SUMMARY OF THE INVENTION

The invention is directed to a container for storing, transporting and disposing radioactive material comprising a vessel and cap each having walls with a core of radioactive shielding material enveloped and isolated within a continuous metal lining.

In the operation of nuclear power stations spent fuel is generally stored in short term storage on the power station site until such radioactive materials have decayed to a state where long term storage or disposal is desirable due to space limitations as material accumulates, and transport to locations off-site does not entail unacceptable risks.

To this end containers have been developed for storing and transporting radioactive material encased within a shell of radioactive shielding material such as concrete for example. Although lead has superior shielding capabilities, due to its high weight, toxicity, and cost, other preferable shielding materials have been developed including high density concrete. To provide corrosion and leakage resistance as well as structural strength to the shell of shielding material, conventional containers often include inner or outer metal liners. Conventional containers having a core of lead are described in the following U.S. Pat. Nos. 3,229,096 to Bonilla et al; 2,514,909 to Strickland; and 4,666,659 to Lusk et al. A hollow concrete-shielded steel outer walled container with a steel inner liner is described in U.S. Pat. No. 3,448,859 to Hall et al. for use in association with liquid wastes.

Conventional containers which utilize lead as a shielding material suffer from disadvantages when compared to concrete shielded containers since lead is relatively expensive. Lead is toxic and therefore requires more careful handling during construction. Lead has a low melting point and low structural strength which are disadvantageous due to the heat generated by radioactive decay.

Lead also has significantly different thermal expansion characteristics compared to the associated composite metal liners used, requiring the designs to incorporate means to allow for differential expansion.

Concrete as a shielding material is preferred therefore since it is less costly and is easily prepared and handled. Concrete also has similar thermal expansion characteristics to steel enabling the use of steel liners and internal reinforcing bars, without the necessity of accommodating differential expansion. However, concrete typically contains pockets of water that has not reacted with the cement powder and therefore concrete is a relatively porous material. Concrete also cracks under thermal or other stresses and upon impact. As a result therefore concrete often allows contaminated fluid to migrate through it reducing its effectiveness as a radioactive shield. Spent fuel elements are often stored under water in short term storage pools within the power station. To minimize the risk of contamination, loading of spent fuel into long term storage containers is preferably carried out under water within the short term storage pools. The water within such pools contains radioactive material and therefore containers with concrete shielding material which is exposed to such contaminated water during loading are unsuitable since the shielding material may become permeated with contaminated water through the cracks and pores of the concrete.

Conventional containers generally comprise a vessel with a central cavity to house the radioactive material and a cap which is bolted to the vessel to seal the cavity. Although bolted caps may be preferred if repeated access is desired, bolted caps and associated flexible gasket seals are often unreliable in the long term due to gasket and bolt corrosion. Bolted caps are also difficult to install since an evenly distributed compressive force is required to seal the flexible gaskets. Frequent inspection is required to ensure initial sealing and maintenance of the seal when bolted caps are used, increasing the associated costs and risks.

The present invention relates to a novel container for storing and transporting radioactive material which overcomes the above disadvantages of conventional containers.

In accordance with the invention is provided a container for storing and transporting radioactive material comprising:

a vessel, having an upwardly open cavity for accommodating said radioactive material, said vessel having walls with a core of concrete shielding material enveloped and isolated within a continuous metal lining; and a cap, covering the top surface of said vessel sealing said cavity, said cap having a core of concrete shielding material enveloped and isolated within a continuous metal lining, the lower outer peripheral edge of said cap being continuously welded to the upper outer peripheral edge of said vessel.

BRIEF DESCRIPTION OF THE DRAWINGS

In order that the invention may be readily understood, one embodiment of the invention will be described below by way of an example with reference to the following drawings.

DETAILED DESCRIPTION

Figure 1:
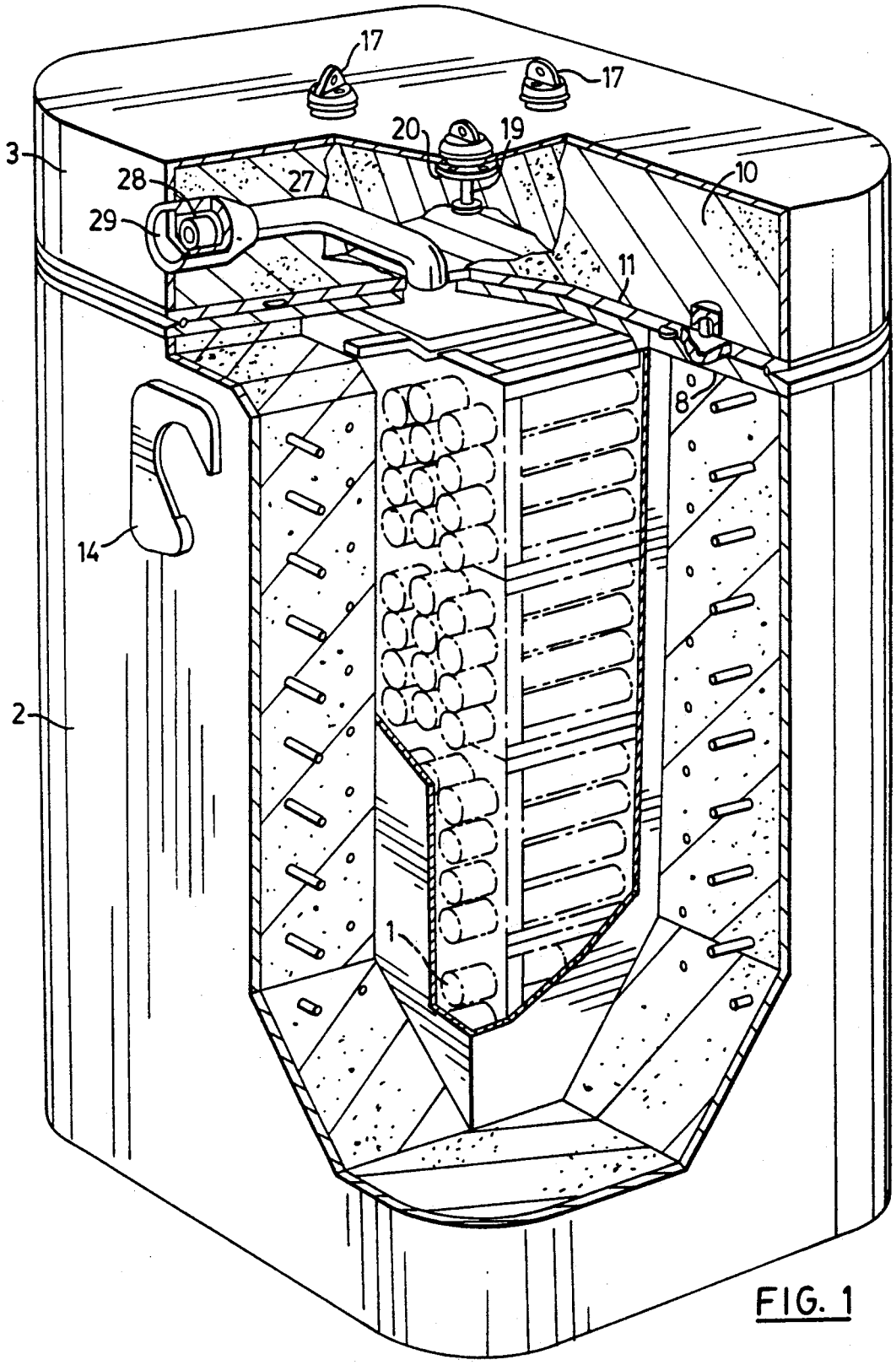
FIG. 1 is a perspective view of one embodiment of the invention, partially broken away to show the internal and external components.

Referring to FIG. 1, a container is provided for storing and transporting radioactive material, such as racks of irradiated fuel bundles 1, comprising a vessel 2 and a cap 3.

Figure 2:
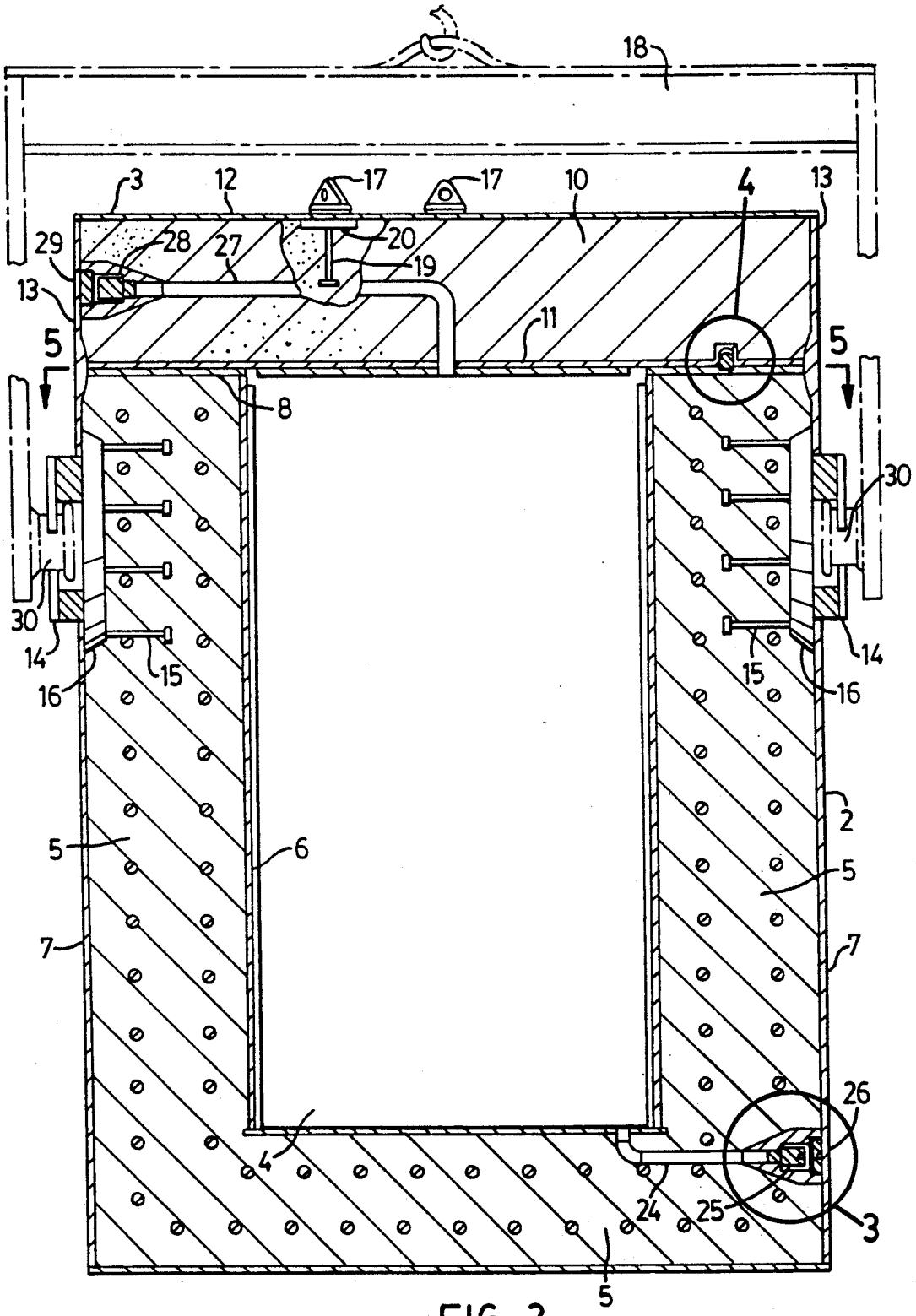
FIG. 2 is a longitudinal sectional view showing the vessel, cap, and lifting lugs.
Figure 5:
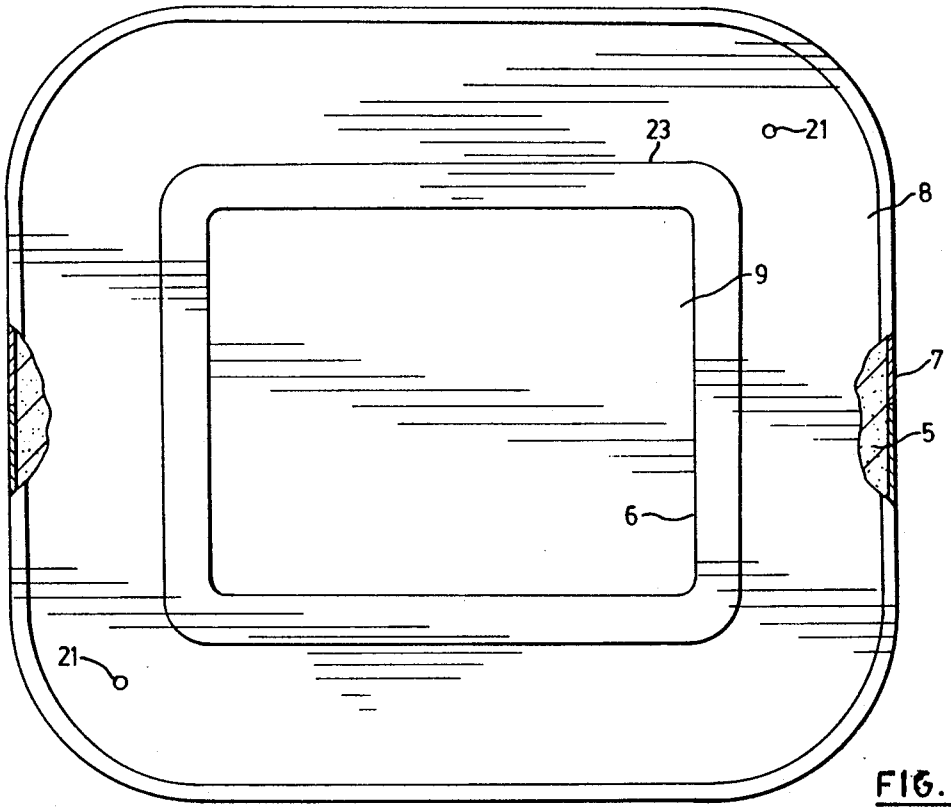
FIG. 5 is a plan view of the top vessel plate showing its central opening and adjacent gasket ring, as well as the outer peripheral weld preparation bevel.

Referring to FIG. 2, the vessel 2 has an upwardly open cavity 4 for accommodating radioactive material. The particular container illustrated has a vessel 2, cavity 4 and cap 3 of substantially rectangular transverse cross-section. The vessel 2 and cap 3 have rounded longitudinal edges. The vessel 2 has walls with a core 5 of radioactive shielding material enveloped and isolated within a continuous metal lining. The vessel's continuous metal lining comprises: an upwardly open internal liner 6; an external vessel liner 7; and a top vessel plate 8 (a plan view of which is shown in FIG. 5). The internal liner 6 has side and bottom walls, the inner surfaces of which define the cavity 4. The external liner 7 also has side and bottom walls which are spaced outward from the internal liner 6. Referring to FIGS. 2 and 5, the top vessel plate 8 has a central opening 9 defining the cavity 4. An inner portion of the top vessel plate 8 adjacent the central opening 9 is continuously welded to an upper portion of the internal liner 6. An outer portion of the top vessel plate 8 is continuously welded to an upper portion of the external vessel liner 7. The concrete shielding material 5 fills the internal space defined by the internal and external vessel liners 6 and 7 and the top vessel plate 8.

The cap 3 covers the top surface of the vessel 2 sealing the cavity 4. The cap 3 also has a core 10 of concrete shielding material enveloped and isolated within a continuous metal lining. The lower outer peripheral edge of the cap 3 is continuously welded to the upper outer peripheral edge of the vessel 2. The continuous metal lining of the cap 3 comprises: a bottom cap plate 11; a top cap plate 12 spaced upward from the bottom plate; and an external cap liner 13. The external cap liner 13 has side walls, the top and bottom portions of which are continuously welded respectively to the outer portions of the top and bottom cap plates 11 and 12. The concrete shielding material fills the internal space defined by the bottom and top cap plates 11 and 12 and the external cap liner 13.

The concrete shielding material of the vessel core 5 and cap core 10 is high density concrete having aggregates of magnetite or specularite preferably. Concrete mixtures also may be designed to impart desirable properties during disposal. Concrete is alkaline and therefore inhibits corrosion of steel liners and reinforcing bars. Ground water containing dissolved salts may penetrate the exterior liner. The alkaline concrete buffers such penetration of corrosive ions. The concrete may be reinforced or not depending upon design stresses. The continuous metal lining of the container is preferably of carbon steel plate due to its relatively low cost and wide availability in a variety of grades. The metal lining may be made of stainless steel, copper, titantium or other metal suitable for the corrosive environment anticipated particularly in a disposal site. The outer surfaces of the container may be coated with epoxy paint to facilitate concrete decontamination. The inner surfaces of the internal liner 6 may also be coated with epoxy paint to inhibit corrosion which clouds the water and impairs the loading operator's vision when the vessel 2 is loaded with concrete material underwater. A particular advantage of the invention is its ability to be loaded underwater such that the shielding material is not exposed to contaminated water and the exterior of the container may be easily decontaminated.

The vessel 2 includes two diametrically opposing lifting lugs 14 attached to the outer side walls of the vessel 2 for lifting the vessel 2 and container. A spreader beam 18 suspended from an overhead crane may be used engaging the lugs 14 with mating trunnions 30 as shown in FIG. 2. The lugs 14 are anchored in the vessel's concrete core 5 using embedded studs 15 welded to a lug anchoring plate 16 which is itself welded to the external vessel liner 7. The cap 3 includes at least one lifting eyelet 17 attached to the top surface of the cap 3 for lifting the cap 3 with a crane. The lifting eyelets 17 are anchored in the cap's concrete core 10 using embedded studs 19 welded to an eyelet anchoring plate 20 which is itself welded to the top cap plate 12.

Figure 4:
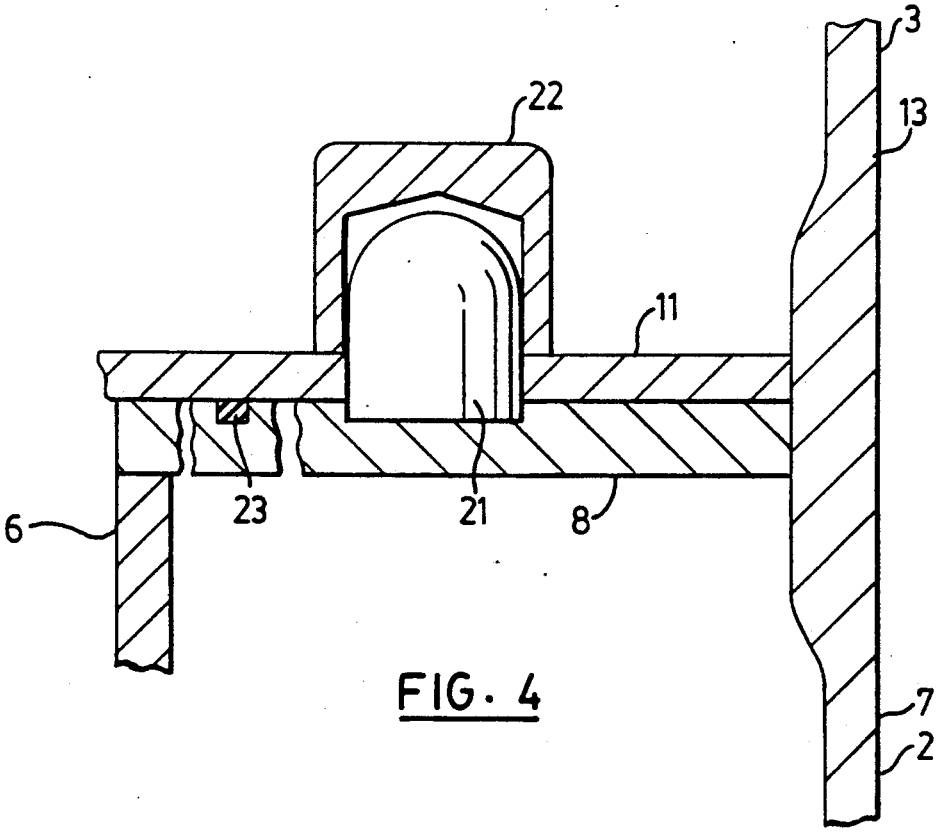
FIG. 4 is a detail sectional view of the gasket ring, aligning pin and socket between the cap and vessel surfaces, as well as the cap to vessel weld.

Referring to FIGS. 2 and 4, in order to accurately and quickly position the cap 3 upon the vessel 2 prior to welding the cap 3 and vessel 2 together, aligning pins 21 and aligning sockets 22 are provided. The aligning pins 21 are connected to the top surface of the vessel as shown by welding to the top vessel plate 8. The aligning sockets 22 are recessed within the lower surface of the cap by welding adjacent a hole in the bottom cap plate 11. The aligning sockets 22 correspond to and mate with the aligning pins 21 to position and align the cap 3 upon the vessel 2.

The container is particularly suited to be loaded with concrete material while immersed in the water of a short term storage pool. In addition to the continuous metal linings which envelope and isolate the concrete radioactive shielding cores, and the epoxy paint coatings described above, underwater loading is further facilitated by the provision of a drain, a vent and a gasket ring. Since the contaminated water, surrounding the radioactive material within the loaded cavity 4, adds to the risk of radioactive leakage and to the corrosion of the metal fuel racks 1, it is desirable to drain the contaminated water from the cavity 4 and to vacuum dry the cavity 4 and its contents prior to transporting the container to long term storage.

A gasket ring 23 is positioned between the top surface of the vessel 2, embedded within a groove in the vessel top plate 8, and the lower surface of the cap 3, such that the gasket ring 23 engages the bottom cap plate 11. Referring to FIG. 5, the gasket ring 23 is positioned adjacent the central opening 9, in the top vessel plate 8, which defines the cavity 4. The gasket ring 23 is used as a temporary seal during the draining and drying of the cavity 4 to seal the cavity 4.

Figure 3:
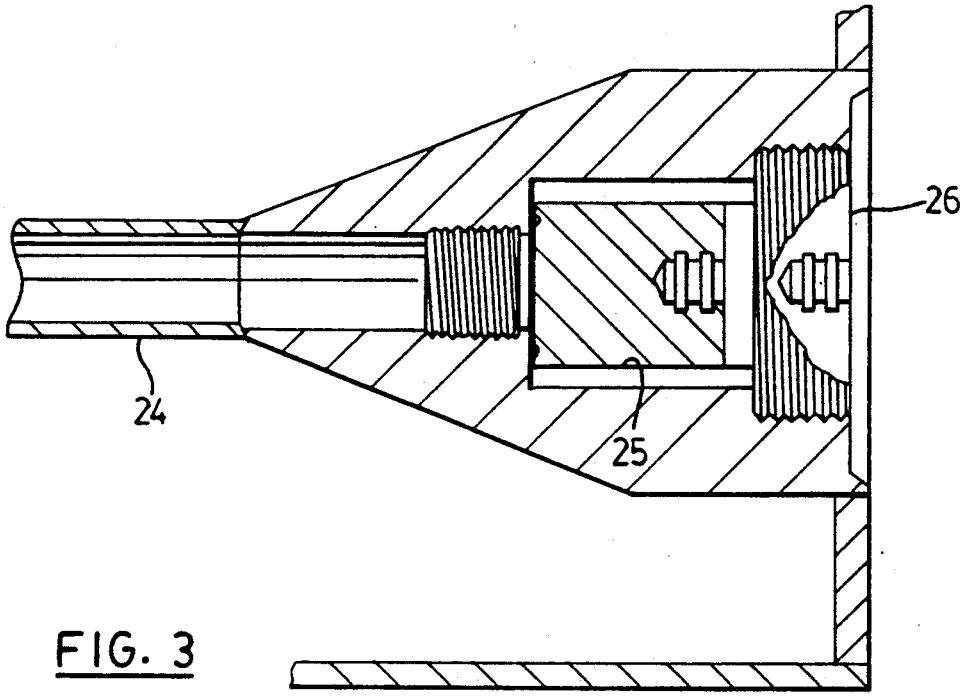
FIG. 3 is a detail sectional view of the drain pipe and drain control means.

Referring to FIGS. 2 and 3, a drain pipe 24 communicates between a lower portion of the cavity 4 and the exterior of the container. Drain control means, comprising first and second drain plugs 25 and 26, are housed within an enlarged outer portion of the drain pipe 24, for sealing the drain pipe 24 and for enabling fluid to pass between the cavity 4 and the exterior of the container.

Referring to FIGS. 1 and 2, a vent pipe 27 communicates between an upper portion of the cavity 4 and the exterior of the container. In the particular embodiment shown the vent pipe 27 is embedded within the cap 3. Venting control means, comprising first and second vent plugs 28 and 29, are housed within an enlarged outer portion of the vent pipe 27, for sealing the vent pipe 27 and for enabling fluid to pass between the cavity 4 and the exterior of the container.

The following sequence of operations is carried out in order to load the container with radioactive material and seal the container. The radioactive material, such as for example irradiated spent fuel bundles 1 are initially stored underwater in racks in the short term storage pools of a nuclear power station. When the radioactive material is to be transferred to another site for long term storage, a vessel 2 with its first and second drain plugs 25 and 26 installed is placed underwater in the short term storage pool by an overhead handling crane above the pool. The crane is fitted with a lifting beam 18 and the lifting beam trunnions are engaged with the lifting lugs 14 of the vessel 2 as shown in FIG. 2. The crane is then used to lift the racks of radioactive material and place them within the cavity 4 of the vessel 2 at all times maintaining the radioactive material underwater. The loaded vessel 2 is then lifted from the pool and placed on a platform adjacent the pool. The cap 2 is lifted by its lifting eyelets and placed upon the top surface of the vessel 3. The weight of the cap 3 compresses the gasket ring 23 to temporarily seal the cavity 4. Aligning pins 21 and mating aligning sockets guide the cap 3 into proper alignment upon the vessel 2. The outer surfaces of the container have previously been coated with epoxy paint to facilitate concrete decontamination. A mixture of water and cleaning solution (such as Alxonox/Alcojet*) is used with long handled brushes to decontaminate the outer surfaces. A chemical cleaner may also be used to further decontaminate the container's outer surfaces.

Vacuum pumps and conduits are then attached to the vent pipe 27 and drain pipe 24 after removal of the vent plugs 28 and 29 and drain plugs 25 and 26. The water from within the cavity 4 is drained away and returned to the pool. The vacuum pump is used to vacuum dry the cavity 4 and its contents via the vent pipe 27 and drain pipe 24 to prevent corrosion of the internal liner 6 and the racks supporting the irradiated fuel bundles. After drying the drain plugs 25 and 26 are replaced and the cavity is back filled with helium gas via the vent pipe 27. The vent plugs 28 and 29 are then replaced and the container is leak tested.

Referring to FIG. 4, the lower outer peripheral edge of the cap 3 is continuously welded to the upper outer peripheral edge of the vessel 2. The weld shown in FIG. 4 is a full penetration butt weld preferably deposited by semiautomatic welding equipment. The cap 3 to vessel 2 weld is inspected by non-destructive methods.

Upon completion of welding the decontaminated container is lifted by the lifting beam 18 and crane and placed upon a flatbed truck or rail car to be transported to its long term storage site. *Trade-mark

We claim:

1. A container for storing and transporting radioactive material comprising:

a vessel, having an upwardly open cavity for accommodating said radioactive material, said vessel having walls with a core of concrete shielding material enveloped and isolated within a continuous metal lining; and a cap, covering the top surface of said vessel sealing said cavity, said cap having a core of concrete shielding material enveloped and isolated within a continuous metal lining, the lower outer peripheral edge of said cap being continuously welded to the upper outer peripheral edge of said vessel.

2. A container according to claim 1 wherein said vessel, cavity, and cap are of substantially rectangular transverse cross-section, said vessel and cap having rounded longitudinal edges.

3. A container according to claim 1 wherein said vessel has a continuous metal lining comprising:

an upwardly open internal liner the inner surfaces of which define said cavity, having side and bottom walls;

an external vessel liner, spaced outward from said internal liner having side and bottom walls; and a top vessel plate, having a central opening defining said cavity, an inner portion of said top vessel plate adjacent said central opening being continuously welded to an upper portion of said internal liner and an outer portion of said top vessel plate being continuously welded to an upper portion of said external vessel liner, said concrete shielding material filling the internal space defined by said internal and external vessel liners and said top vessel plate.

4. A container according to claim 1 wherein said cap has a continuous metal lining comprising:

a bottom cap plate;

a top cap plate, spaced upward from said bottom cap plate; and an external cap liner having side walls the top and bottom portions of which are continuously welded respectively to the outer portions of said top and bottom cap plates, said concrete shielding material filling the internal space defined by said bottom and top cap plates and said external cap liner.

5. A container according to claim 1 wherein said concrete shielding material comprises aggregates selected from the group consisting of magnetite and specularite.

6. A container according to claim 1 wherein said continuous metal lining comprises material selected from the group consisting of copper, titanium, and carbon steel plate.

7. A container according to claim 1 wherein outer surfaces of said container are coated with epoxy paint to facilitate radioactive decontamination.

8. A container according to claim 1 wherein said vessel includes two diametrically opposing lifting lugs attached to its outer side walls for lifting said vessel and container.

9. A container according to claim 1 wherein said cap includes a lifting eyelet attached to its top surface for lifting said cap.

10. A container according to claim 1 comprising:

a vent pipe communicating between an upper portion of said cavity and the exterior of the container; and venting control means within said vent pipe for sealing said vent pipe and for enabling fluid to pass between said cavity and the exterior of the container.

11. A container according to claim 1 comprising:

a drain pipe communicating between a lower portion of said cavity and the exterior of said container; and drain control means within said drain pipe for sealing said drain pipe and for enabling fluid to pass between said cavity and the exterior of said container.

12. A container according to claim 1 comprising:

a vent pipe communicating between an upper portion of said cavity and the exterior of the container;

venting control means within said vent pipe for sealing said vent pipe and for enabling fluid to pass between said cavity and the exterior of the container;

a drain pipe communicating between a lower portion of said cavity and the exterior of said container; and drain control means within said drain pipe for sealing said drain pipe and for enabling fluid to pass between said cavity and the exterior of said container.

13. A container according to claim 1 comprising:

aligning pins connected to the top surface of said vessel; and aligning sockets within the lower surface of said cap corresponding to and mating with said aligning pins to align said cap upon said vessel.

14. A container according to claim 1 comprising:

a gasket ring, between the top surface of said vessel and the lower surface of said cap, adjacent said cavity, sealing said cavity.

* * * * *